United States Patent [19]

Eckel et al.

[11] Patent Number: 5,033,384

[45] Date of Patent: Jul. 23, 1991

[54] BRAKING FABRIC FASTENED TO THE BASE OF A CARRIER PROJECTILE CONTAINING ARTICLES OF SUBMUNITION

[75] Inventors: Alfred Eckel, Treuchtlingen; Gunther Thurner, Schwaig, both of Fed. Rep. of Germany

[73] Assignee: Diehl GmbH & Co., Nuremberg, Fed. Rep. of Germany

[21] Appl. No.: 493,470

[22] Filed: Mar. 14, 1990

[30] Foreign Application Priority Data

Mar. 25, 1989 [DE] Fed. Rep. of Germany ..... 3909902

[51] Int. Cl.[5] ..... F42B 10/32; F42B 10/48

[52] U.S. Cl. ..... 102/386; 102/489; 244/3.27; 244/138 R

[58] Field of Search ..... 244/3.1, 3.27, 3.3, 244/113, 138 R; 102/293, 337, 338, 339, 340, 348, 354, 386, 387, 388, 400, 489, 505

[56] References Cited

U.S. PATENT DOCUMENTS

| | | | |
|---|---|---|---|
| 4,215,836 | 8/1980 | Zacharin | 244/3.27 |
| 4,565,341 | 1/1986 | Zacharin | 102/386 |
| 4,696,443 | 9/1987 | Zacharin | 102/386 |
| 4,753,171 | 6/1988 | Stessen | 102/387 |
| 4,854,241 | 8/1989 | Synofzik et al. | 102/489 |
| 4,856,432 | 8/1989 | Synofzik | 102/489 |
| 4,856,737 | 8/1989 | Zacharin | 102/386 |
| 4,860,660 | 8/1989 | Synofzik et al. | 102/489 |
| 4,958,565 | 9/1990 | Koch | 102/386 |
| 4,958,566 | 9/1990 | Siebrand et al. | 244/3.27 |

FOREIGN PATENT DOCUMENTS

| | | |
|---|---|---|
| 3608107 | 1/1987 | Fed. Rep. of Germany . |
| 3642391 | 6/1988 | Fed. Rep. of Germany . |
| 3643293 | 6/1988 | Fed. Rep. of Germany . |

*Primary Examiner*—Charles T. Jordan

*Attorney, Agent, or Firm*—Scully, Scott, Murphy & Presser

[57] ABSTRACT

A braking fabric or canvas which is fastened to the base of a carrier projectile which contains articles of submunition, through the intermediary of a fastening device, wherein the canvas is spread apart or unfolded after the separation of the base from the carrier projectile and is provided for the retardation and change in the trajectory of the base relative to the articles of submunition. The braking fabric is connected by a central surface section thereof with at least one plate element forming the fastening device. This connection between the at least one plate element and the braking fabric is preferably effectuated through an adhesive connection. Naturally, it is also possible to select a different type in effecting the connection; for example, such as a riveting connection, a combined adhesive and riveting connection, or any other suitable type of connection.

10 Claims, 5 Drawing Sheets

22
22
30
14
16
28
20
12
24
28
30
22
16
18
28
10
16
22
22

22
10
22
24
30
28
22
14
28
16
12
30
16
28
22
28
16
20
18
30
16
22
22
22

BRAKING FABRIC FASTENED TO THE BASE OF A CARRIER PROJECTILE CONTAINING ARTICLES OF SUBMUNITION

BACKGROUND OF THE INVENTION

1. Field of the Invention

The present invention relates to a braking fabric or canvas which is fastened to the base of a carrier projectile which contains articles of submunition, through the intermediary of a fastening device, wherein the canvas is spread apart or unfolded after the separation of the base from the carrier projectile and is provided for the retardation and change in the trajectory of the base relative to the articles of submunition.

2. Discussion of the Prior Art

A braking fabric of that type, which may essentially have a function like that of a braking parachute, or, in essence, a carrier projectile for articles of submunition which is equipped with such a braking canvas is known from the disclosure of U.S. Pat. No. 4,753,171, assigned to the common assignee of this application. In that particular instance, the braking fabric or canvas is equipped with centrifugal masses or flyweights, which are preferably fastened to the braking canvas through the intermediary of fettering lines. For the spreading apart or unfolding of the braking fabric there are hereby employed the centrifugal forces which exert their effect on the flyweights or centrifugal masses, and which are initiated as a result of the spin of the carrier projectile and thereby through the spin imparted to the base of the carrier projectile. Hereby, during the spreading open or unfolding sequence of the braking fabric, mechanical strains can be encountered in the braking fabric, which not only may obstruct the uniform unfolding of the braking fabric, but forces can also become effective herein which can lead to the damaging of the braking fabric. With regard to the fastening device for the attachment of the braking fabric to the base of the carrier projectile which contains the articles of submunition, in this known carrier projectile this preferably pertains to a retainer ring about which the braking fabric is slung with its inner edge portion. In this manner, there is obtained only a relatively small connecting region between the braking fabric and the fastening device. Inasmuch as the totality of the mechanical forces which become effective during the unfolding sequence come into play in the braking fabric within this relatively small connecting region between the braking fabric and the fastening device, there are produced comparatively high stress loads in this region.

SUMMARY OF THE INVENTION

Accordingly, it is an object of the present invention to provide a braking fabric or canvas of the above-mentioned type wherein, in a rapid and problemless manner, the fabric can be readily unfolded through the action of inertial forces which act on the braking fabric subsequent to the separation of the base from the carrier projectile, and which concurrently possesses a good mechanical strength.

The foregoing object is inventively achieved in that the braking fabric is connected by a central surface section thereof with at least one plate element forming the fastening device. This connection between the at least one plate element and the braking fabric is preferably effectuated through an adhesive connection. Naturally, it is also possible to select a different type in effecting the connection; for example, such as a riveting connection, a combined adhesive and riveting connection, or any other suitable type of connection. With regard to the plate element, which is connected on one side thereof with the braking fabric, this can pertain to a steel disc. It has been ascertained as being expedient when the braking fabric is arranged with its central surface section positioned between two plate elements which form the fastening device. Consequently, the braking fabric is not only connected to the base of the carrier projectile by means of a comparatively small-sized annular or ring-shaped surface section, but through the intermediary of a central surface section which is defined by the basic surface of the at least one plate element, and preferably of that of the two plate elements. In this manner, there is not only obtained an improvement in the mechanical connection between the base of the carrier projectile and the braking fabric, but also additionally the advantage that the introduction of the torque from the base of the carrier projectile which possesses a spin into the braking fabric is comparatively readily implemented from the center of the base. As a result thereof, the unfolding of the braking fabric produced through the centrifugal force by means of the base is significantly improved.

A good mechanical connection between the braking fabric and the plate elements is obtained when the braking fabric is adhesively fastened intermediate the two plate elements. For this purpose, there can be employed a multi-component adhesive which is applied to both oppositely facing central surface sections of the braking fabric, whereupon the two plate elements are then positioned on the two main oppositely facing surfaces of the braking fabric. The braking fabric is clamped between the two plate elements such that, subsequent to the curing of the multi-component adhesive, there is produced a good mechanical connection between the braking fabric and the two plate elements.

The plate elements are preferably provided with through-apertures whereby, respectively, one through-aperture in one plate element is in alignment with a corresponding through-aperture in the second plate element, and presently a fastening element is passed through respectively each of the mutually aligned through-apertures. This kind of construction for the braking fabric is possessed of the advantage that by means of the fastening elements the plate elements, which clamp the braking fabric therebetween, can be screw-fastened to each other or to the base of the projectile by means of the fastening elements. With regard to the fastening elements, these pertain, for example, to screws through the use of which the braking fabric is preferably fastened onto the front surface of the base which faces towards the carrier projectile.

Moreover, it has been found to be expedient when for a mechanical reinforcement or strengthening of the braking fabric, there are provided reinforcing bands on the braking fabric, which extend from the central surface section of the braking fabric in a direction towards its outer periphery, whereby the longitudinal segments of the reinforcing bands extending towards the central surface section are covered by the two plates. Hereby, the reinforcing bands can extend in a radial direction, or preferably in contrast with the radial direction extend obliquely in a tangential direction or, in essence, in a direction approaching the tangential direction, away from the central surface section, whereby the unfolding or spreading procedure for the braking fabric is subsequent to the separation of the base from the carrier projectile is still further improved. Thereby, in that the longitudinal segments of the reinforcing bands which extend towards the central surface sections are fastened in position between the two plate elements, a major portion of the mechanical loads or strains acting on the unfolded braking fabric are taken up by the reinforcing bands. The braking fabric is thus accordingly mechanically unstressed so that this will avoid any loads or strains leading to a premature rupture or tearing of the braking fabric or canvas.

The reinforcing bands are preferably arranged on both opposite basic surfaces of the braking fabric. As a result thereof, there are obtained extremely uniform strain or stress conditions in the unfolded braking fabric, as well as a uniform unfolding or spreading out behavior for the braking fabric.

The reinforcing bands commencing in pairs from the central surface section or portion of the braking fabric, can extend convergingly in a V-shape towards the peripheral edge, whereby an arm portion of the V-shape or each of the V-shapes is provided on the one basic surface and the second arm portion of the V-shape or each of the V-shapes on the oppositely located second basic surface. As a result, there is obtained an at least approximately tangential orientation of the reinforcing bands, through which the effective centrifugal forces are transmitted in an improved manner.

In order to avoid weakening locations in the reinforcing bands, it has been ascertained as being expedient, when the through-apertures of the plate elements which are in alignment with each other for the passing through of the fastening elements are located intermediate the two end segments of the two elbows of each V-shape which are distant from each other and face towards the central surface section. With a construction of that kind for the braking fabric, the reinforcing bands thus do not include any apertures which are in alignment with the through-apertures in the plate elements, so as to thereby avoid the formation of any weakening locations in the reinforcing bands.

The V-shapes of the reinforcing bands in such a braking fabric are preferably distributed in the peripheral direction of the braking fabric. In view thereof, there is obtained not only an extremely uniform unfolding and spreading out of the braking fabric over the bottom of the base which has been separated from the carrier projectile, but also a uniform force or strain distribution between the spread out braking fabric and the carrier projectile base.

The braking fabric preferably includes a uniform odd-numbered multi-cornered peripheral contour. The peripheral contour of the braking fabric, in essence, can be equilaterally three-cornered, or preferably equilaterally cornered five-cornered or, in essence, equilaterally seven-cornered or the like. Such a construction for the braking fabric produces the further advantage that a single reinforcing band can extend alternatingly on one surface of the braking fabric from one corner to a second corner, on the opposite second side of the fabric from the second corner to a third corner, from the third corner again to the first side of the braking fabric to a fourth corner and so forth, until the reinforcing band again leads back to the first corner. The more corners such a braking fabric possesses, the smaller can be the inner circle which is enclosed by the reinforcing band, along which the through-apertures of the plate elements are arranged uniformly distributed, without that the through-apertures pass through the reinforcing band with a formation of weakening locations.

BRIEF DESCRIPTION OF THE DRAWINGS

Further details, features and advantages of the invention can now be more readily ascertained from the following detailed description of exemplary embodiments of the inventive braking fabric, taken in conjunction with the accompanying drawings; in which.

DETAILED DESCRIPTION

Figure 1:
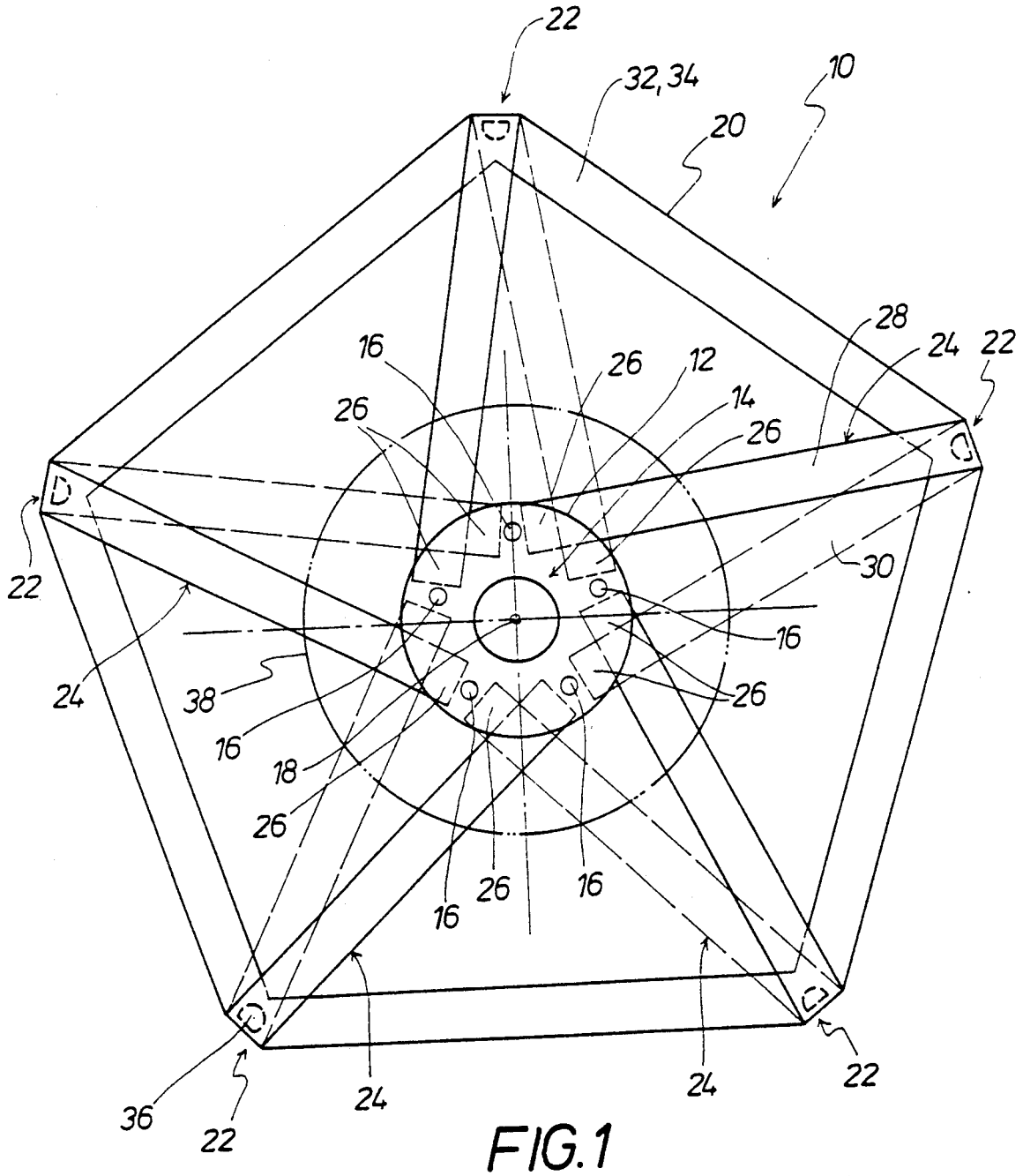
FIG. 1 illustrates a plan view of an unfolded or spread equilateral five-cornered braking fabric with V-shaped extending reinforcing bands and with an additional reinforcing band which extends about the peripheral edge of the braking fabric.

FIG. 1 illustrates a braking canvas or fabric 10 in the spread out or unfolded condition. The braking fabric 10 has its central surface section or portion 14 clamped between two plate elements 12. Plate elements 12 are formed with through-apertures 16 which are uniformly spaced with respect to each other along a circle which is concentric with the center 18. The two plate elements 12 are arranged in a manner on the two main surfaces of the braking sheet 10 which are located opposite each other such that the respective through-apertures 16 thereof are presently in alignment with each other.

The braking fabric 10 possesses an equilateral five-cornered outer periphery 20 and, correspondingly each plate element 12 is provided with five through-apertures 16. Reinforcing bands 24 extend between the central surface section 14 which is covered by the plate elements 12 and the corners 22 of the braking fabric 10, whereby the reinforcing bands have their end segments 26 extending towards the central surface section 14 clamped between the two plate elements 12, and which terminate in front of the through-apertures 16. As can be clearly ascertained from this drawing figure, the reinforcing bands 24 extend along the two opposite sides of the braking fabric 10 in a V-shape, whereby presently the one arm portion 28 of each V-shaped reinforcing band 24 extends along the one side of the braking fabric 10 and the second arm portion 30 presently extends along the opposite second side of the braking fabric 10 between the central surface 14 and the applicable corner 22 on the braking fabric. In this manner there is obtained a uniform orientation of the reinforcing bands 24 or, in essence, their arm portions 28 and 30, and an approximately tangential orientation of the arm portions 28 and 30 of the reinforcing bands 24, so that there is afforded a uniform spreading or unfolding of the braking fabric 10 and a uniform force or strain distribution.

Fastened to the braking fabric 10 along the peripheral edge section 32 bordering the outer periphery 20 is an additional reinforcing band 34. This additional reinforcing band 34 is preferably fastened to both of the opposite sides of the braking fabric 10. The attachment of the reinforcing bands 24, 34 can be implemented, for example, by means of a zig-zag seam.

In the regions of the corners 22 there can be provided flyweights or masses 36. These weights 36 can be sewn into the reinforcing bands.

Through the intermediary of a braking fabric of that type there is achieved the advantage of attaining an outstanding transfer of the torque from the base 38 of a carrier projectile to the braking fabric 10 through the two plate elements 12 which clamp the braking fabric 10 between each other. Inasmuch as the reinforcing bands 24 have their end segments 26 which extend towards the central surface section 14 similarly clamped between the two plate elements 12, and are oriented in an at least approachingly tangential direction extending away from the plate elements 12, then by means of the reinforcing bands 24 there is further supported the transmission of the torque to the braking fabric 10 and as a result a secure spreading out or unfolding of the braking fabric 10.

Figure 2:
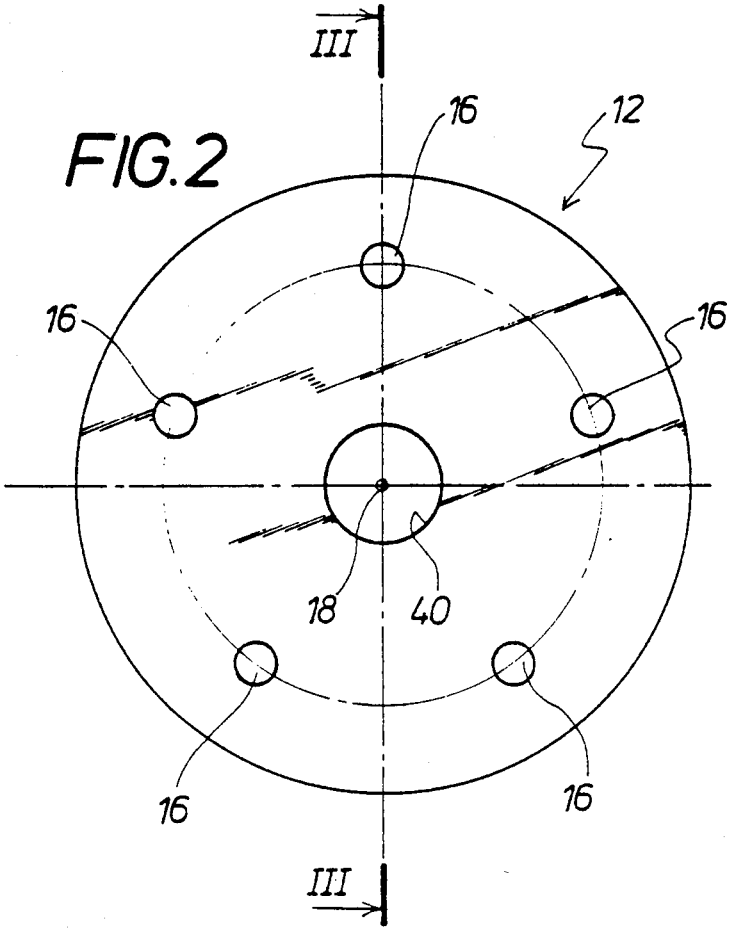
FIG. 2 illustrates a front view of a plate element.
Figure 3:
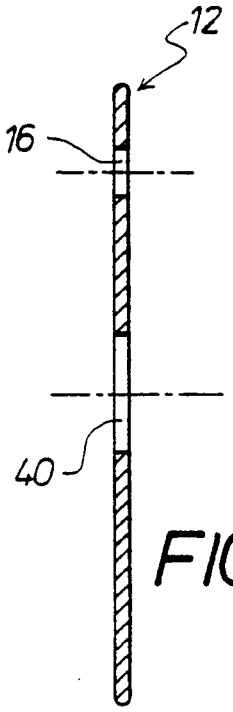
FIG. 3 illustrates a sectional view taken along line III—III in FIG. 2.

The FIGS. 2 and 3 illustrate, in respectively front view and cross-sectional representation, one of the two plate elements 12, which is equipped with two apertures 16 which are spaced equidistantly from each other and coaxially relative to the center 18. The plate elements 12 are preferably constituted from a fiber-reinforced plastic material which, for example, may pertain to a fiberglass-reinforced plastic. The plate element or respectively each plate element 12 is formed with a central aperture 40.

Figure 4:
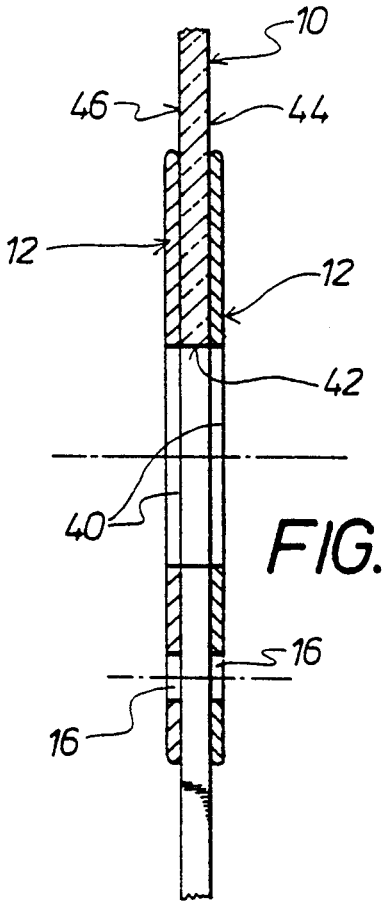
FIG. 4 illustrates a sectional view through a segment of a braking fabric which is fastened intermediate two plate elements.

FIG. 4 illustrates a fragmentary represented braking fabric 10 which is fixedly clamped between two plate elements 12. The braking fabric 10 possesses a central aperture 42 which is in alignment with the central apertures 40 in the two plate elements 12. The fastening between the two plate elements 12 and the braking fabric 10 is effectuated through an adhesive connection between the two respective sides 44 and 46 of the braking fabric 10 and the basic surfaces of the plate elements 12 facing these sides. From this drawing figure there can also be ascertained the through-apertures 16 in the two plate elements 12 which are in alignment with each other and through which there are passed through fastening elements (not shown) which may consist of, for example, fastening screws, by means of which the braking fabric 10 is attached to the base (not shown) of a carrier projectile containing the articles of submunition.

Figure 5:
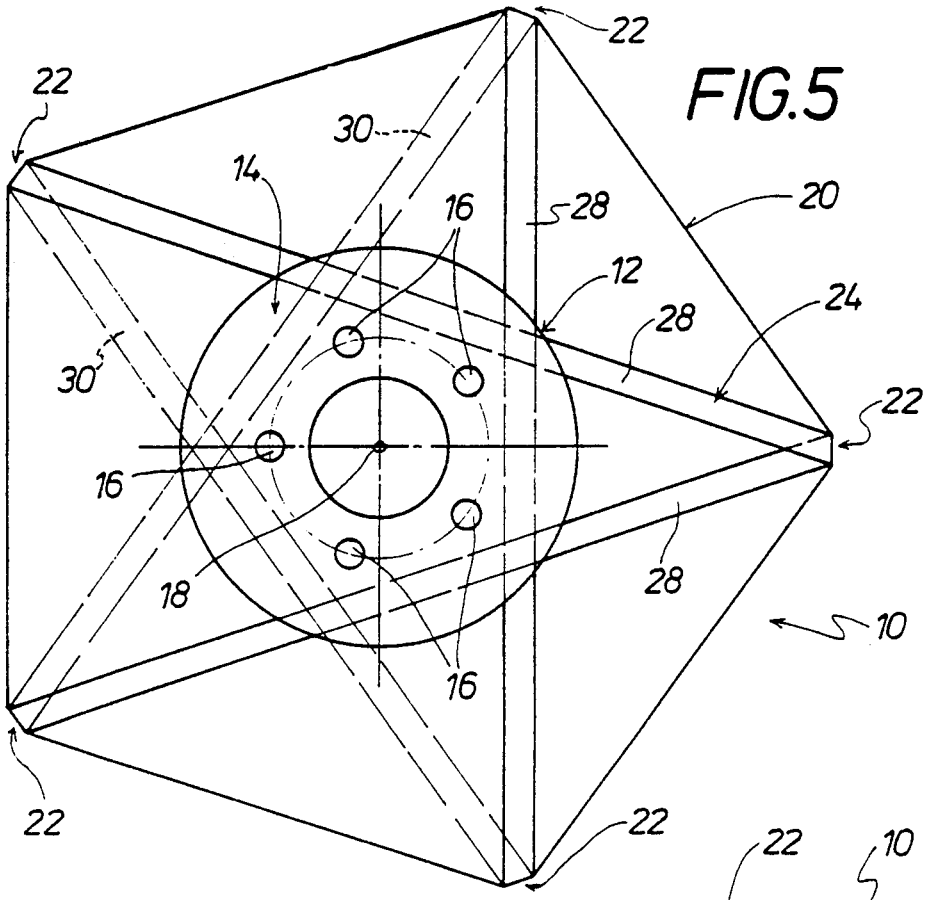
FIG. 5 illustrates a schematic view of a spread out or unfolded equilateral five-cornered braking fabric, in which the winding path of the reinforcing bands distinguishes itself from the path of the reinforcing band illustrated in FIG. 1.
Figure 6:
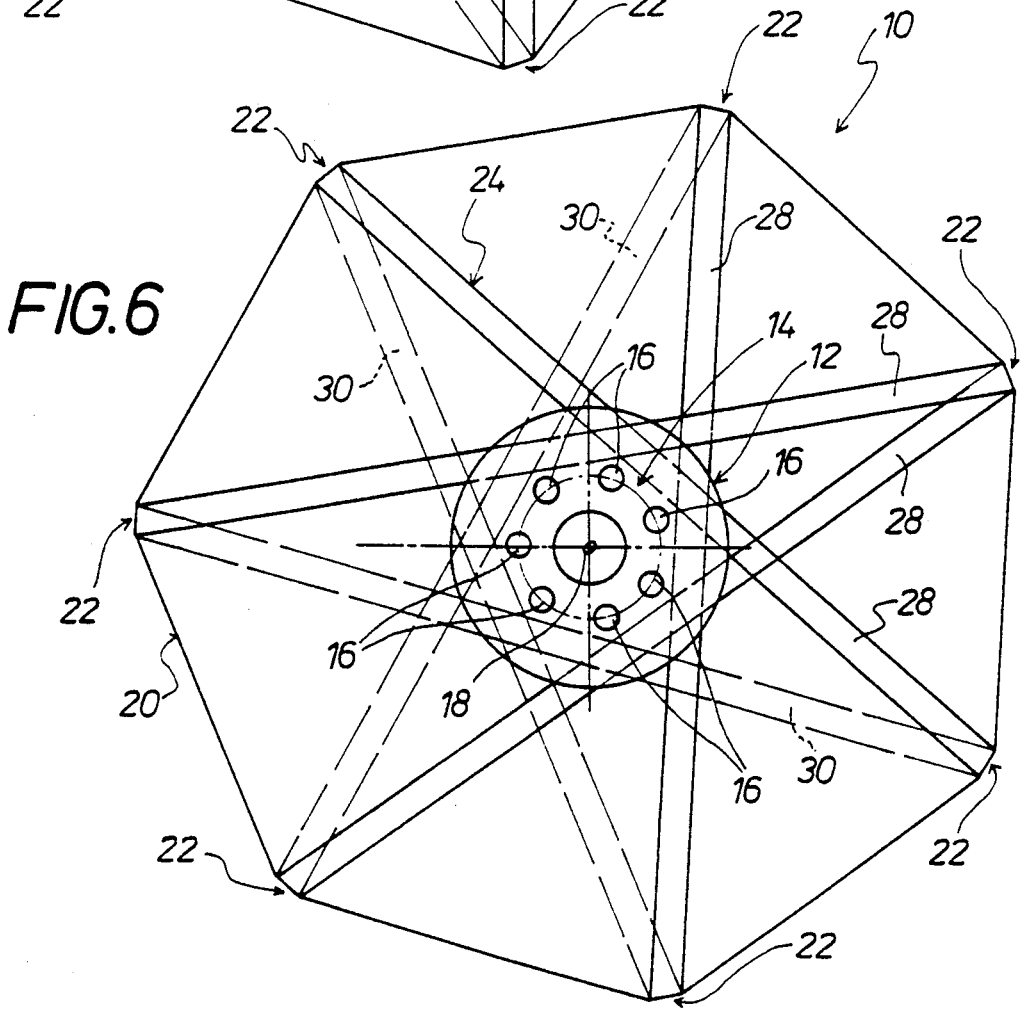
FIG. 6 illustrates a schematic representation of a construction for the braking fabric corresponding to that of FIG. 5; however, which is configured equilaterally and seven-cornered with one reinforcing band.

In FIGS. 5 and 6 there are respectively illustrated two exemplary embodiments of the braking fabric 10, shown schematically in the spread out or unfolded condition, which, in particular, distinguish themselves from the exemplary embodiment of the braking fabric 10 as illustrated in FIG. 1 in that there are no longer provided any V-shape extending reinforcing bands 20 on the braking fabric 10, but presently only a single reinforcing band 24 which, commencing from one corner 22 shown in FIG. 5, extends on the one side of the braking fabric 10 to the after the next corner 22, from this after the next corner 22 along the opposite second side to the next to the last corner 22, from there along the first side of the braking fabric to the second corner 22 and from the second corner along the opposite second side of the braking fabric 10 towards the fourth corner 22 and from the fourth corner 22 to the first side of the braking sheet 10 back to the first corner 22. The arm portions 28 and 30 which alternatingly extend along the one and then along the other side of the braking fabric 10, in FIG. 5 enclose a five-cornered central surface section 14 in which, along a circle which is concentric with the center 18, there are provided the apertures 16 at a spacing from the respective arms 28 or 30 of the reinforcing band 24, so that the through-apertures 16 will not cover themselves over with the reinforcing band 24. Preferably, the through-apertures 16 are provided in the corner segments of the central surface section 14 which are defined by the respective arm portions 28 or 30. Through the reference numeral 20 there is also hereby identified the outer periphery of the braking fabric 10.

The braking fabric 10 which is schematically illustrated in FIG. 6 in the spread out or unfolded condition, in particular distinguishes itself from the braking fabric 10 which is illustrated in FIG. 5 in that it possesses an equilateral seven-cornered outer periphery 20, whereby the reinforcing band 24 which closes into itself, commencing from one corner 22, extends with one arm portion 28 along the one side of braking fabric 10 to the after the next fourth corner 22, from this fourth corner 22 with a second arm portion 30 along the second side of the braking fabric 10 back to the seventh corner 22, from the seventh corner 22 with one arm portion 28 along the first side of the braking fabric 10 to the third corner 22, from there with a second arm portion 30 along the opposite second side of the braking fabric 10 to the sixth corner 22, from the sixth corner 22 with one arm portion 28 along the first side of the braking fabric 10 to the second corner 22, from there with a second arm portion 30 along the second side of the braking fabric 10 to the fifth corner 22 of the braking fabric 10 and from there with one arm portion 28 back to the first corner 22. By means of the arm portions 28 and 30 of the reinforcing band 24 there is defined an equilateral seven-cornered central surface section 14, within which there are arranged seven through-aperatures 16 uniformly spaced from each other along a circle which is concentric with the center 18 on the plate elements 12 located on the two opposite sides of the braking fabric 10. Through-apertures 16 do not intersect with the arm portions 28 and 30 of the reinforcing band 24, so that there is obtained a good mechanical strength. The through-apertures 16, in this configuration of the braking fabric 10 are also preferably located in the vicinity of the corners of the central surface section 14.

Figure 7:
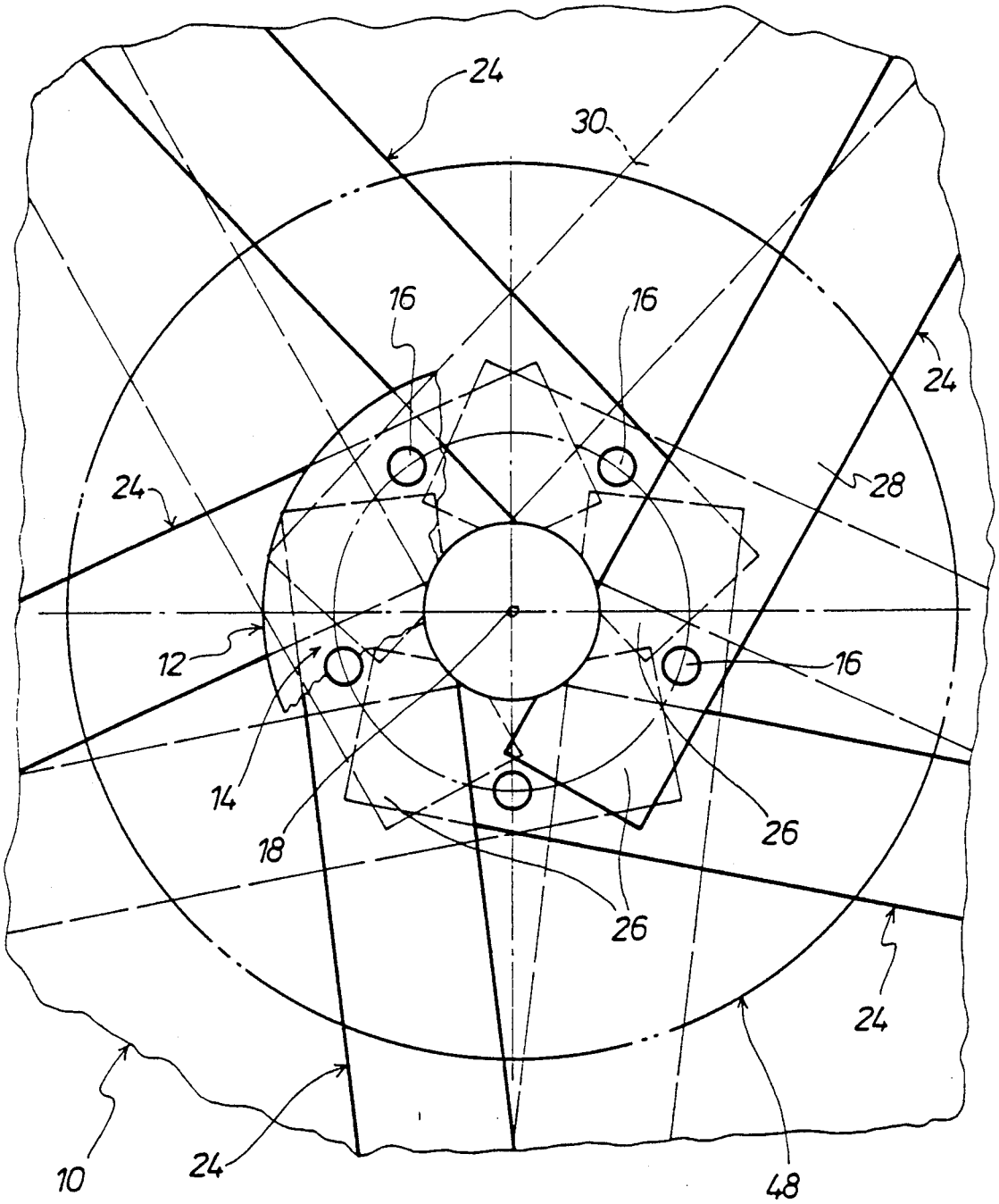
FIG. 7 illustrates a construction of a partially shown braking fabric in which the arrangement of the reinforcing bands differs from that in the arrangement of FIG. 1.

FIG. 7 illustrates, on an enlarged scale, a segment of an exemplary embodiment of the braking fabric 10 shown in the spread out or unfolded condition, and which is equipped with V-shape extending reinforcing bands 24. This constructive embodiment of the braking fabric 10 distinguishes itself in particular from the configuration of the braking fabric 10 which is illustrated in FIG. 1 in that the end segments 26 of the reinforcing bands 24 which face the central surface section 14 possess another orientation relative to the center 18; in essence, the spacing of the two arm portions 28 and 30 of each V-shaped reinforcing band 24 which in this figure converge towards the outer periphery 20 (not shown), is smaller than the spacing between the arm portions 28 and 30 of each V-shape extending reinforcing band 24 of the braking fabric 10 illustrated in FIG. 1. The two plate elements 12 which are fastened to the opposite sides of the braking fabric 10, of which only one is shown herein in partial representation, have their through-apertures 16 oriented in such a manner relative to other V-shaped reinforcing bands 24, that the mutually aligned apertures 16 of the two plate elements 12 each pass through presently only two arm portions of the V-shaped reinforcing bands 24, whereas always four further arm portions of the V-shaped reinforcing bands 24 are provided towards the sides adjacent the applicable apertures 16. For the remainder, the configuration of the braking fabric 10 shown in FIG. 7 is similar to that embodiment of the braking sheet 10 illustrated in FIG. 1, so that it is unnecessary to again describe in further detail more extensive particulars of the braking fabric in conjunction with FIG. 7. Through the reference numeral 48 there is identified in FIG. 7 an element which forms a protection against chaffing, and which is provided for reducing the mechanical contact of the reinforcing bands 24 with the base of the carrier projectile containing the articles of submunition.

Through the at least approachingly tangential paths of the reinforcing bands 24 on the two opposite sides of the braking fabric, in an advantageous manner there is afforded an improvement in the assumption of the opening loads acting on the braking fabric 10. The braking fabric is constituted, for example, of a nylon weave or fabric which is designed in such a manner as to be able to assume the encountered incident aerodynamic flow forces which are during the spreading out or unfolding; in effect, the unfolded condition of the braking fabric. The reinforcing bands 24 and 34 can be constituted, for example, from a Kevlar material.

Figure 8:
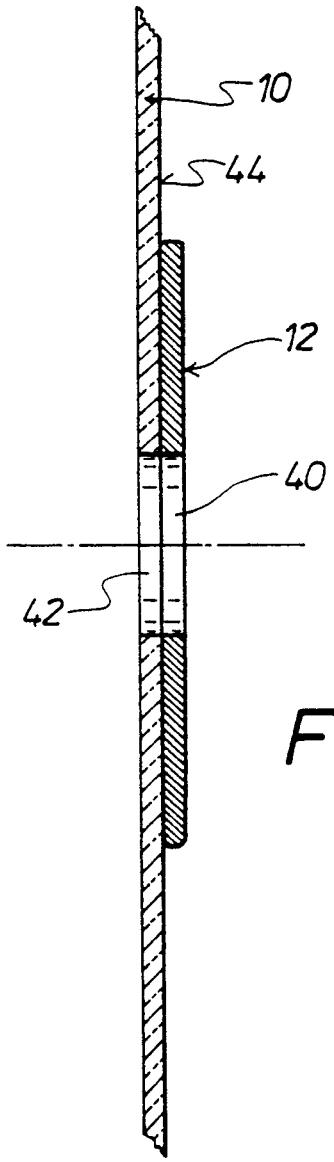
FIG. 8 illustrating a cross-sectional representation corresponding to FIG. 4 through a partially shown braking fabric which is connected with a single plate element.

FIG. 8 illustrates a central segment of a braking fabric 10 which possesses a central aperture 42. A plate element 12 which, for example, is constituted of a steel disc, is adhesively fastened over a large surface area to one side 44 of the braking fabric. The plate element 12 possesses a central aperture 40 and is arranged on the braking fabric 10 in such a manner; in essence, is adhesively fastened thereto, such that the apertures 40 and 42 are in alignment with each other. In this drawing figure there has not been illustrated the representation of through-apertures 16, for example, as are ascertainable from FIG. 4. However, this does not signify in the construction of the plate element 12 as shown in FIG. 4 that the element could not possess such kinds of through-apertures.

What is claimed is:

1. A braking fabric including a fastening means for attaching said fabric to the base of a carrier projectile containing articles of submunition, said braking fabric being unfolded upon separation of said base from said carrier projectile so as to serve for the braking and change in the trajectory of the base relative to the articles of submunition; at least one plate element being connected with a central surface section of said braking fabric so as to form said fastening means, said at least one plate element including through-apertures, each said through-aperture having an associated fastening means extending therethrough; reinforcing bands being arranged on the braking fabric to provide a mechanical reinforcement, said reinforcing bands extending pairwise from said central surface section of the braking fabric V-shaped convergingly in a direction towards the outer periphery of the fabric, the end segment of the reinforcing bands which extend towards said central surface section each being covered by said at least one plate element; and the through-apertures being arranged between the two spaced end segments extending towards the central surface section of the two arm portions of respectively each said V-shaped reinforcing band.

2. A braking fabric as claimed in claim 1, wherein said central surface section of said fabric is positioned intermediate two of said plate elements so as to form said fastening means.

3. A braking fabric as claimed in claim 2, wherein said braking fabric is adhesively fastened between said two plate elements.

4. A braking fabric as claimed in claim 2, wherein each said through-aperture in one said plate element being in alignment with a respective through-aperture in the other said plate element; and one said fastening means extending respectively through each of the mutually aligned through-apertures.

5. A braking fabric as claimed in claim 1, wherein said reinforcing bands are arranged on opposite sides of the braking fabric.

6. A braking fabric as claimed in claim 1, wherein an arm portion of each V-shaped reinforcing band is arranged on one side and a second arm portion of each V-shaped reinforcing band is arranged on the opposite side of the braking fabric.

7. A braking fabric as claimed in claim 1, wherein further said reinforcing bands are arranged to extend along the outer periphery of the braking fabric.

8. A braking fabric as claimed in claim 7, wherein the reinforcing bands and the further reinforcing band each include weights in the region of the outer periphery of the braking fabric.

9. A braking fabric as claimed in claim 1, wherein the V-shaped reinforcing bands extending from the central surface section of the braking fabric are uniformly distributed in the peripheral direction of the braking fabric.

10. A braking fabric as claimed in claim 1, wherein the braking fabric possesses an equilateral, odd-numbered, multi-cornered peripheral contour.

* * * * *